US010639639B2

(12) United States Patent
Scharfe et al.

(10) Patent No.: US 10,639,639 B2
(45) Date of Patent: May 5, 2020

(54) COMMINUTING DEVICE

(71) Applicant: PMS Handelskontor GmbH, Hamburg (DE)

(72) Inventors: Oscar Scharfe, Hamburg (DE); Felix Scharfe, Hamburg (DE)

(73) Assignee: PMS Handelskontor GmbH, Hamburg (DE)

( * ) Notice: Subject to any disclaimer, the term of this patent is extended or adjusted under 35 U.S.C. 154(b) by 422 days.

(21) Appl. No.: 15/559,110

(22) PCT Filed: Feb. 11, 2016

(86) PCT No.: PCT/EP2016/052939

§ 371 (c)(1),
(2) Date: Oct. 12, 2017

(87) PCT Pub. No.: WO2016/146307

PCT Pub. Date: Sep. 22, 2016

(65) Prior Publication Data

US 2018/0243747 A1 Aug. 30, 2018

(30) Foreign Application Priority Data

Mar. 18, 2015 (DE) ..... 10 2015 104 078

(51) Int. Cl.
*B02C 13/00* (2006.01)
*B02C 13/26* (2006.01)
*B02C 13/20* (2006.01)

(52) U.S. Cl.
CPC ..... *B02C 13/26* (2013.01); *B02C 13/205* (2013.01)

(58) Field of Classification Search
CPC ..... B02C 13/205; B02C 13/20; B02C 13/26
USPC ..... 241/187, 188.2
See application file for complete search history.

(56) References Cited

U.S. PATENT DOCUMENTS 4,084,756 A * 4/1978 Coxhill ..... B02C 2/06 241/213
4,113,191 A * 9/1978 Wattles ..... B02C 13/18 241/188.2
4,232,833 A * 11/1980 Werginz ..... B02C 2/047 241/207

(Continued)

FOREIGN PATENT DOCUMENTS

CN 1079842 A 12/1993
CN 2351419 Y 12/1999

(Continued)

*Primary Examiner* — Faye Francis
(74) *Attorney, Agent, or Firm* — Welsh Flayman & Gitler LLC

(57) ABSTRACT

The invention relates to a comminuting device including a cylinder casing which surrounds a comminuting chamber, in which several rotors can be operated independently from each other with individual drives, said rotors being driven by concentric shafts which are arranged concentrically to the central axis (z) of the comminuting chamber, said concentric shafts having a central shaft and at least one outer hollow shaft surrounding said central shaft. At least one lubricant line for connecting to a lubricant supply is arranged in the central shaft and/or in a shaft casing, the lubricant line being connected by at least one radial lubricant through guide to at least one bearing of the rotors.

13 Claims, 1 Drawing Sheet

(56) References Cited

U.S. PATENT DOCUMENTS

RE30,919 E * 5/1982 Sautter ..... B02C 13/1835 241/275
4,420,064 A * 12/1983 Lohnherr ..... F16N 7/02 184/103.1
4,478,373 A * 10/1984 Gieschen ..... B02C 2/045 241/208
4,522,343 A * 6/1985 Williams ..... B02C 15/001 241/110
4,524,917 A * 6/1985 Williams ..... B02C 15/02 241/101.2
4,634,134 A * 1/1987 Entrikin ..... B02C 17/18 241/171
4,666,092 A * 5/1987 Bremer ..... B02C 2/047 241/214
4,910,987 A * 3/1990 Woodrow ..... B21B 31/078 241/101.2
5,044,809 A * 9/1991 Galanty ..... F16J 15/344 241/46.06
5,098,026 A * 3/1992 Dougan ..... B02C 15/005 241/101.2
5,718,391 A * 2/1998 Musil ..... B02C 2/045 241/207
5,725,163 A * 3/1998 Eloranta ..... B02C 2/06 241/207
5,732,896 A * 3/1998 Jakob ..... B02C 2/047 241/215
5,964,422 A * 10/1999 Ruokonen ..... B02C 2/02 241/216
5,996,916 A * 12/1999 Musil ..... B02C 2/047 241/215
6,328,237 B1 * 12/2001 Thysell ..... B02C 2/047 241/213
6,877,682 B2 * 4/2005 Nieminen ..... B02C 2/00 241/36
7,857,248 B2 * 12/2010 Eriksson ..... B02C 25/00 241/207
7,922,109 B2 * 4/2011 Persson ..... B02C 2/047 241/209
8,474,738 B2 * 7/2013 Virtanen ..... B02C 13/205 241/187
2003/0136865 A1 * 7/2003 Karra ..... B02C 2/00 241/33
2011/0168821 A1 * 7/2011 Virtaven ..... B02C 13/205 241/191
2014/0008475 A1 * 1/2014 Sjoberg ..... B02C 2/04 241/207

FOREIGN PATENT DOCUMENTS

| | | | |
|---|---|---|---|
| CN | 1946481 | A | 4/2007 |
| CN | 201020384 | Y | 2/2008 |
| DE | 2538577 | | 3/1976 |
| DE | 9109608 | U1 | 10/1991 |
| DE | 102012104031 | | 11/2013 |
| EP | 0950856 | A | 10/1999 |
| GB | 1531254 | A | 11/1978 |
| JP | 2000-240575 | A | 9/2000 |
| WO | WO2008122691 | | 10/2008 |

* cited by examiner

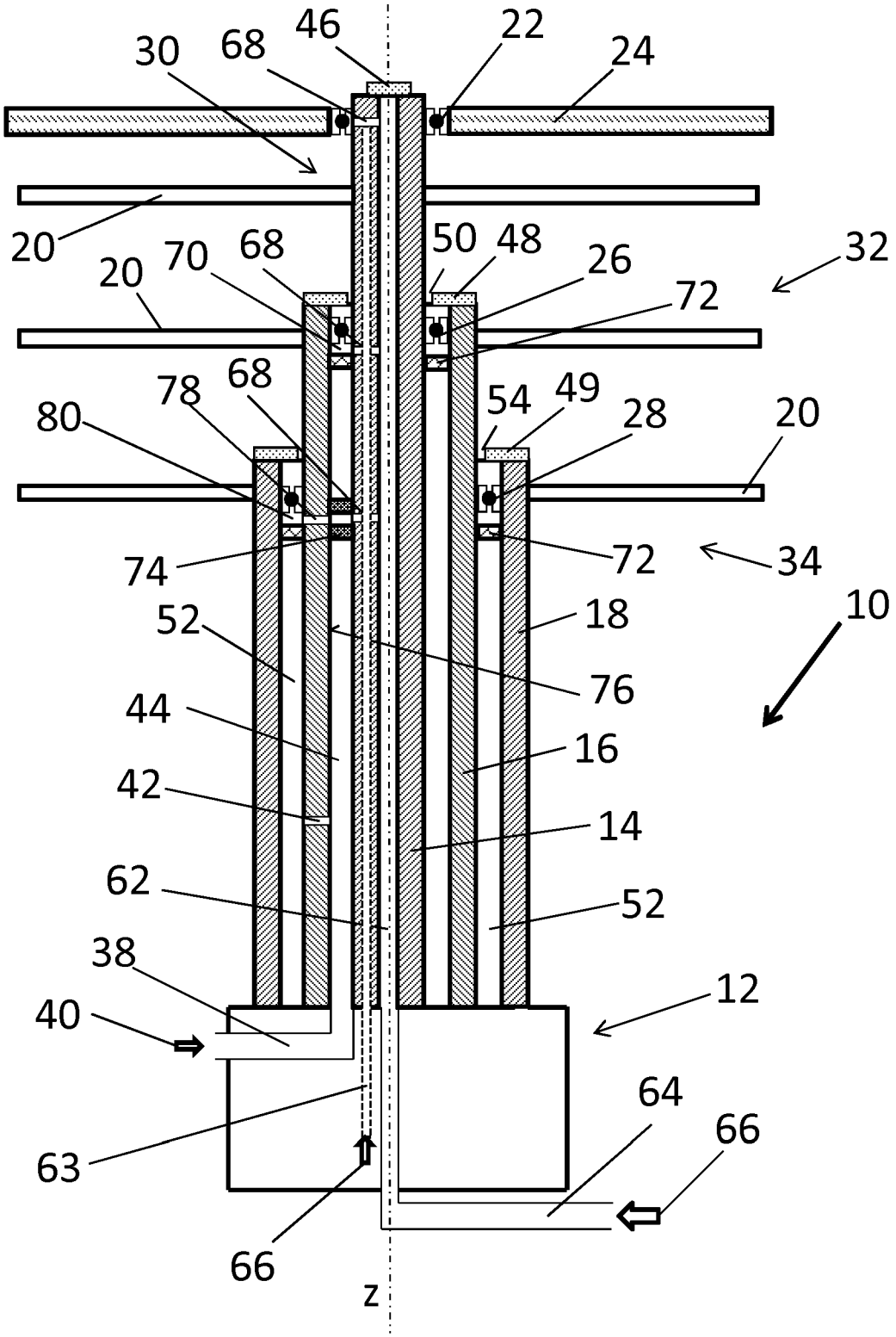
46
22
30
68
24
20
50
48
32
20
70
68
26
72
68
78
54
49
80
28
20
74
72
34
10
52
18
76
44
16
42
14
62
52
38
12
40
64
66
63
66
z

COMMINUTING DEVICE

BACKGROUND OF THE INVENTION

This invention relates to a comminuting device including a cylinder jacket which surrounds a cylindrical comminuting chamber. In the comminuting chamber several rotors are driven and can be operated independently of one another via shafts which are concentric to one another. The rotors are arranged concentrically to the central axis of the comminuting chamber. The concentric shafts encompass a central shaft and at least one outer hollow shaft which surround the latter. One such comminuting device is known for example from German Patent No. DE 10 2013 110 352 A. As in this invention, striking tools are connected to at least two of the rotors. One of the rotors can be a fan rotor. When materials are being comminuted, shards and dust form which can adversely affect the bearings of the coaxial shafts or can reduce their service life.

SUMMARY OF THE INVENTION

It is an object of the invention to provide a comminuting device which allows a longer service life of the rotors and their bearings As disclosed in the invention, in the central shaft and/or in a shaft jacket, there is at least one lubricant line for connection to a lubricant feed. The lubricant line is connected via at least one radial lubricant duct to at least one bearing of the rotors.

The invention thus makes it possible to transport lubricant to the shaft bearings via longitudinal bores which are located in the shafts. These longitudinal bores extend in the axial direction of the shafts and act as the lubricant line in order to feed lubricant, i.e. an oil and/or grease, to the axial regions in which the shaft bearings are located. There can be several separate longitudinal bores, i.e. lubricant lines for different shaft bearings in order to thus be able to supply an individual amount of lubricant and/or an individual lubricant pressure to the individual shaft bearings.

The lubricant line can also pass without transition into the lubricant duct when the latter is bent to the outside on the end where the shaft bearing is located. The lubricant line could also be slightly inclined to the outside so that it emerges from the shaft jacket exactly in the axial bearing region. Here the lubricant line and the lubricant duct would be made integrated, for example by a sloped arrangement of a bore in the shaft jacket. But conventionally the lubricant line is formed by an axial bore in the shaft jacket and the lubricant duct is formed by a radial bore in the shaft jacket. If there is a bore in the shaft jacket which runs at first axially but slightly tilted, the lubricant line and the lubricant duct are integrated in one bore in the shaft jacket.

The lubricant duct can discharge directly into the bearing. However, this would make machining of the bearing necessary, for example to provide lubricant feed bores in the outer bearing shell. Therefore the lubricant duct discharges preferably into a ring region on/in which there is a shaft bearing. The lubricant is thus supplied to the shaft bearing from the open side. Of course shaft bearings which lie radially outside and also radially within the lubricant duct can be supplied with lubricant. Thus the lubricant duct can extend through the entire thickness of the shaft jacket and then the lubricant duct discharges into an axial region inside and also outside the shaft jacket. In this way two bearings can be supplied directly with lubricant.

In one advantageous embodiment of the invention, the ring region is formed in a first axial direction by a bearing and in the opposite second axial direction by a lubricant seal. The lubricant seal then forces the lubricant in the ring region in the direction of the bearings where it can contribute effectively to lubrication of the shaft bearing. Preferably the lubricant seal is gas-permeable. This has the advantage that pressurized gas action on the shaft arrangement can traverse the lubricant seal, with which the pressurized gas, for example compressed air, can pass via the bearings to the outside in the comminuting chamber. In this way the bearing region can be kept effectively free of dust from the comminuting chamber.

Preferably the lubricant line is connected on the front end of the rotors to an annular feed space so that the lubricant line can be fed with lubricant regardless of the rotational position of the shafts.

Preferably in the central shaft or in the intermediate space there is a lubricant line which is connected to at least one bearing. In this way not only does air flow around the bearing or bearings so that no material dust can penetrate into them, but lubricant is also fed to the bearings, with which their lubrication in operation remains ensured. The lubricant is fed to the bearings preferably via radial lubricant ducts which are made in the shaft jackets. This measure also greatly increases the service life of the bearings and thus symbiotically interacts with the gas feed because the gas ensures that the lubricant is not contaminated by material particles which arise during comminution, in which case the contaminated lubricant would act as a grinding agent.

Preferably the central shaft is made as a hollow shaft and the lubricant line runs in the cavity of the central shaft which is designed to connect to a lubricant feed. In this way lubricant is fed to the bearings via the cavity in the central shaft. Thus not only can be bearings between the shafts be lubricated, but also a bearing between the central shaft and a fixed structure of the comminuting device relative to the motor/bearing block.

Preferably at least one shaft in its shaft jacket has one radial lubricant duct from the inside of the shaft to the outside of the shaft, which lubricant duct is connected to a bearing which is located there. In this way the lubricant can be easily distributed from the central shaft to the surrounding bearings between the central shaft and the outer shaft or between the several outer hollow shafts.

When "radial" is used in this application, this means that the alignment has a radial component. The direct radial alignment of the corresponding components is only one preferred embodiment.

In one advantageous development of the invention at least one shaft in the region of its lubricant duct contains a radially extending lubricant channel which adjoins the wall of the adjacent shaft in the region of one lubricant duct which is located in the latter. The lubricant channel is connected torsionally strong to the shaft. This results in that per revolution the lubricant channel is aligned once with the lubricant duct of the adjacent shaft, and the lubricant accordingly is transferred radially. Thus the lubricant can be routed radially to the outside or inside such that the lubricant penetrates one lubricant duct of a shaft which lies farther to the outside or inside once per revolution.

Preferably the lubricant channel at least in the region adjoining the wall has a contact material which can slide with respect to the material of the shaft.

Preferably the comminuting device has means for determining the position of each individual shaft. There is an electronic control in which one lubrication position of the shafts which are concentric to one another is stored, and in which the lubricant channel is aligned with the lubricant duct of the adjacent shaft. In this lubrication position the bearings can be lubricated when the brief alignment of the lubricant channel with the lubricant duct during normal operation is not sufficient to ensure lubricant supply to the bearings which are radially farther away.

Preferably the lubricant channel, at least in the region adjoining the wall of the adjacent shaft, has a contact material which can slide with respect to the material, as a result of which the lubricant channel can easily slide along the wall of the adjacent shaft without noteworthy friction, i.e. heat generation during operation. Between the lubricant channel and the wall of the adjacent shaft there can also be a distance, i.e. a gap, which is so small that lubricant cannot emerge from this gap to a noticeable extent.

Preferably the radial lubricant duct extends into a ring region which in the first axial direction is sealed by a bearing and in the opposite second axial direction by a lubricant seal which is made especially annular. This prevents the lubricant from being fed to the entire intermediate space, but essentially only to the bearing. Thus gas can be fed in the remaining intermediate space in order to keep the bearings free of material dust.

Preferably the lubricant seal is gas-permeable so that it prevents lubricant from the region of the bearing from reaching the remaining intermediate space, but on the other hand enables the passage of gas from the intermediate space to the bearing and to the lubricated region.

In one advantageous development of the invention, in the central shaft an interior space is made and/or between the shafts at least one intermediate space is made. The interior/intermediate space is made at least partially as a gas feed space for connection to a gas feed, which gas feed space is connected to at least one shaft bearing which is located between the shafts. In this way not only the lubricant, but also gas, for example air, is supplied to the bearings in order to keep them free of dust. This has the synergistic effect that the lubricant which has been fed to the bearings is not mixed with dust either; thus could also engender an unfavorable emery effect. The shaft bearings thus remain both clean (dust-free) and also lubricated.

Preferably the intermediate space is connected to an end piece which is rotationally mounted thereon and which has a gas feed opening for connection to a gas feed. In this way the gas supply becomes independent of the rotational position of the shafts.

Preferably at least one of the shafts has a gas duct which extends radially in the shaft jacket and which is connected to one shaft bearing. The gas can be easily distributed in the radial direction via the latter.

In one advantageous development of the invention the gas duct discharges into a first gas ring region which is formed in a first axial direction by a bearing and in the opposite second axial direction by an annular gas seal. Via this gas ring region the gas can be fed to the shaft bearing very effectively over a large area from the side. Moreover, modifications of the bearing, for example providing gas feed openings in the outer bearing shell, are not necessary.

Preferably the central shaft has an axially extending cavity or interior space which is on the one hand connected to the intermediate space via a gas duct which extends radially in the shaft jacket, and on the other hand is designed for connection to a gas feed. In this way the gas from the central gas feed can be supplied effectively to the intermediate spaces between the shafts from the interior space in the central shaft. Thus all shaft bearings between several coaxial shafts can be flushed with gas.

In one advantageous development of the invention the gas feed is formed by a fan which can be easily implemented.

Preferably all intermediate spaces between the shafts are connected to the gas feed so that all shaft bearings of the comminuting device are flushed with gas, and thus have a long service life.

During gas feed the intermediate space between the concentric shafts is preferably used to feed air or some other gas to the bearings which are located between the shafts and optionally also to a bearing between the central shaft and a fixed structure of the comminuting device in order to keep the dust from the dust which forms when the materials are being comminuted away from these bearings. The gas feed can be for example a fan which feeds ambient air, optionally filtered, to the bearings. The gas feed can also be connected to a cavity in the central shaft, by means of which the supplied air or the supplied gas is routed via radial gas ducts to the intermediate spaces between the shafts.

This approach as claimed in the invention has the advantage that the bearings for the rotors are exposed to much less wear, the shafts themselves having to be only minimally altered. Thus simply small radial penetrations in the shaft jackets are necessary in order to be routed as a gas duct to intermediate spaces which are located farther outside, for example between the central shaft and the first outer shaft or between the first outer shaft and a second outer shaft which surrounds it. No axial gas lines need be drilled in the shaft jackets; this would be associated with comparatively high cost. Thus the invention allows protection of the rotor bearings of a comminuting device which is very easy to accomplish.

It goes without saying that the shafts which are concentric to one another are connected on at least one side to drive motors, for example a combined motor/bearing block, via which they are driven independently of one another. These motors are located on one front end of the shafts. On this end the shafts in the motor/bearing block are also supported on the motors. On the opposite end at least the central shaft is supported on a fixed structure, for example the frame or end wall of the comminuting chamber.

Preferably the gas duct discharges into a ring region of an intermediate space which is formed on the one hand by a bearing and on the other by an annular gas seal. In this way the gas is not fed to the entire intermediate space, but only to a limited axial region of the intermediate space between the gas seal and the bearing.

Preferably the central shaft has an axial cavity/interior space which is used in conjunction with a gas feed as a gas supply to the intermediate space. The axial cavity of the central shaft is on the one hand connected to the intermediate space via a gas duct which extends radially in the shaft jacket and on the other it is designed for connection to a gas feed, for example a fan. In this way the gas, in particular air, is fed via the axial cavity in the central shaft and from there into the intermediate space between the central shaft and a first outer hollow shaft. Optionally, from there the gas is fed into other intermediate spaces between other outside hollow shafts. The number of shafts corresponds preferably to the number of rotors, the number of rotors, i.e. of concentric shafts, being preferably between two and five.

Preferably the intermediate space and/or the cavity of the central shaft is connected to an end piece which is rotationally mounted thereon and which has a gas feed opening for connection to a gas feed. In this way the gas can be easily fed to the annular intermediate space/cavity of the central shaft.

The gas feed in one simple embodiment can be formed by a fan, but also other pressurized gas devices can be used, for example pressure pumps or pressurized gas accumulators. Ambient air is suited as the simplest gas. But in the case of certain materials it can be a good idea to supply inert gases, such as for example $CO_2$ or nitrogen, in order to prevent the oxidation or the ignition of materials during comminution. In this way then not only are the bearings kept free of dust, but the comminuting chamber can also be flushed with a desired gas which is inherently important to the comminution process.

In one embodiment of the invention all intermediate spaces between the shafts are connected to the gas feed; this has the advantage that all bearings between all shafts which are concentric to one another are flushed with the supplied gas and thus remain free of comminuted material.

The following terms are used synonymously; shaft bearing—bearing; longitudinal bore—lubricant line; cavity—interior space—lubricant line.

The above described embodiments of the invention can be combined in any manner as long as several features do not technically contradict one another.

BRIEF DESCRIPTION OF THE DRAWING

FIG. 1 shows a partially cutaway view of a comminuting device with three rotors and three shafts which are concentric to one another with a combined gas and lubricant feed.

DETAILED DESCRIPTION OF THE INVENTION

FIG. 1 shows a comminuting device 10 in a schematic partially cutaway view along its longitudinal axis z. The cylinder material and the entire bottom region of the comminuting device are not shown. The comminuting device 10 includes a motor/bearing block 12 which rotationally supports three shafts which are concentric to one another, and which drives specifically a central hollow shaft 14, a first outer hollow shaft 16 which surrounds the latter, and a second outer hollow shaft 18 which surrounds the first outer hollow shaft 16. The three hollow shafts 14, 16, 18 are located concentrically around the central axis Z of the comminuting chamber. At least one, preferably two, and most preferably each concentric shaft 14, 16, 18 bears striking tools 20 in order to crush material supplied from above (for example mineral conglomerates). The three shafts 14, 16, 18 can be controlled individually via three separate motors in the motor/bearing block 12 so that they can each be driven in opposite directions and with increasing speed. In this way very effective comminution of the supplied material can be achieved. The drawing does not show a cylinder jacket which surrounds the rotors 14, 16, 18 and a comminuting chamber defined in its interior. The central hollow shaft 14 on its lower end is supported on the motor/bearing block 12 and on the opposite upper end by means of a first bearing 22 on a fixed structure 24 of the comminuting device 10, for example a wall. The first outer hollow shaft 16 is radially supported and centered relative to the central hollow shaft 14 with a second bearing 26. The second outer hollow shaft 18 is radially supported and centered relative to the first outer hollow shaft 16 with a third bearing 28. The three bearings 22, 26, 28 provide for the concentric shafts to remain concentrically aligned when material is being comminuted. The sections of the concentric shafts 14, 16, 18 which are not covered to the outside form rotors 30, 32, 34 on which the striking tools 20 are anchored in a manner which is not detailed. Preferably the striking tools 20 are held interchangeably on the rotors 30, 32, 34. The striking tools 20 can be bars or chains or similar known functional elements, as are known from German Patent No. DE 10 2013 110 352 A. When materials are being comminuted, in particular mineral-containing materials, a large amount of dust is formed which could rapidly adversely affect or destroy the bearings of the shafts.

So that the bearings are well lubricated, lubricant is fed to the bearings 22, 26, 28. In the comminuting device 10 shown the central cavity 62 of the central hollow shaft 14 is made as a lubricant line which is connected via a lubricant feed line 64 to a lubricant feed 66, for example a pressurized lubrication apparatus. In the region of the first bearing 22 the central cavity 62 has a first radial lubricant duct 68 which leads directly to the first bearing 22 and thus leads to lubrication of the first bearing 22. A second lubricant duct 68 leads into an inner annulus 70 which is made between the second bearing 26 and an annular lubricant seal 72. The lubricant seal 72 causes the lubricant to be fed only to the inner annulus 70 and thus to the bearing 26 and not into the underlying first intermediate space 44. In the central hollow shaft 14 there is moreover another lubricant duct 68 which discharges into a lubricant channel 74 which is attached radially outside on the central hollow shaft 14. The lubricant channel 74 adjoins the inside wall 76 of the first outer hollow shaft 16 on the outside and is located at a height at which the lubricant channel 74 can be aligned with an outer lubricant duct 78 in the first outer hollow shaft 16. In this way the lubricant channel 74 will align in a certain rotational position of the central hollow shaft 14 relative to the first outer hollow shaft 16 with the outer lubricant channel 78 of the first outer hollow shaft 16. Thus lubricant is supplied to an outer annulus 80 between the first outer hollow shaft 16 and the second outer hollow shaft 18, which outer annulus 80 is bordered to the bottom by a ring-shaped lubricant seal 72 and to the top by the third bearing 28. In this way enough lubricant is also fed to the third bearing 28 which lies farthest to the outside. If the short alignment of the lubricant channel 74 with the outer lubricant duct 78 is too short to feed enough lubricant to the outer annulus 80 and thus to the third bearing 28, it can be provided that an electronic control determines the position of the shafts 14, 16, 18 to one another via corresponding sensors and can position the central outer hollow shaft 14 and the first outer hollow shaft 16 in one lubricant position relative to one another such that the lubricant channel 74 is aligned with the outer lubricant duct 78. In this position the third bearing 28 can be lubricated. If it is not aligned with the outer lubricant duct 78, the lubricant channel 74 is closed by the inside wall 76 of the first outer hollow shaft 16. The lubricant channel 74 in this sense can slide either gently along the inside wall 76 of the first outer hollow shaft 16 or it has a minimum distance to the latter which prevents the escape of lubricant.

Moreover the central cavity 62 is connected to a third lubricant duct 68 which feeds lubricant to the uppermost bearing 22. Thus lubricant is supplied to all bearings 22, 26, 28 via the central cavity 62 and the lubricant ducts 68.

In addition or alternatively to the central cavity 62, a lubricant line 63 (shown by the broken line) can be located in one shaft wall 14 in the form of an axial bore which is connected to the lubricant ducts 68, preferably all of them. In this way then the central cavity 62 can be used for gas feed. This alternative can also be used when the central shaft 14 does not have a central cavity 62.

The first intermediate space 44 is connected via a gas line 38 to a gas feed 40, for example a fan. The lubricant seal 72 between the central hollow shaft 14 and the first outer hollow shaft 16, as well as between the first outer hollow shaft 16 and the second outer hollow shaft 18, are permeable to gas. Moreover, in the first outer hollow shaft 16 there is a gas duct 42 through which the gas, for example air, which has been supplied from a gas feed 40 is also fed to the second intermediate space 52 between the first outer hollow shaft 16 and the second outer hollow shaft 18. In this way the second bearing 26 as well as the third bearing 28 are supplied with gas. In this embodiment the two bearings 26, 28 are not only supplied with lubricant, but also with a gas, for example ambient air, so that they are not fouled with dust of the comminuted matter and thus have a long service life.

On the free end of the central hollow shaft 14 there is a central cover 46 which closes the central cavity 36 towards the free end. On the end of the first outer hollow shaft 16 there is a first ring cover 48 which is spaced apart from the central hollow shaft 14 by a first gap 50. This first ring cover 46 on the one hand affects a mechanical barrier against the penetration of dust from the comminuting chamber. On the other hand, due to the narrowing of the exit in the first gap 50 between the central hollow shaft 14 and the first ring cover 48 the available flow space is extremely reduced; this leads to the gas emerging there with a correspondingly increased velocity. The safeguarding of the second bearing 26 against the penetration of dust is greatly improved. In the first outer hollow shaft 16 there is a radial gas duct 42 so that the gas is routed into a second intermediate space 52 which is located between the first outer hollow shaft 16 and the second outer hollow shaft 18. From there the gas is fed to the third bearing 28 and travels through a second gap 54 between the first outer hollow shaft 16 and a second ring cover 49 into the comminuting chamber. In the second gap 54 the gas velocity is in turn increased so that this offers very good protection against the penetration of dust and larger material grains into the third bearing 28.

The first bearing can be located outside of the comminuting chamber, in which case gas flushing is not unconditionally necessary.

This invention is not limited to the described exemplary embodiments, but can be varied in any way within the protective domain of the attached claims.

REFERENCE NUMBER LIST

10 comminuting device (first embodiment)
12 motor/bearing block
14 central hollow shaft
16 first outer hollow shaft
18 second outer hollow shaft
20 striking tools
22 first bearing
24 fixed structure
26 second bearing
28 third bearing
30 first rotor
32 second rotor
34 third rotor
36 central cavity
38 gas line
40 gas feed
42 gas duct
44 first intermediate space
46 central cover
48 first ring cover
49 second ring cover
50 first gap
52 second intermediate space
54 second gap
60 comminuting device (second embodiment)
62 central cavity
64 lubricant feed line
66 lubricant feed
68 lubricant duct
70 inner annulus
72 lubricant seal
74 lubricant channel
76 inside wall of the first outer hollow shaft
78 outer lubricant duct
80 outer annulus

The invention claimed is:

1. A comminution device comprising a cylinder surrounding a comminution chamber, in which a plurality of rotors are driven independently from each other by their own drives, the plurality of rotors are driven via a plurality of concentrical shafts which are arranged concentrically to a central axis (z) of the comminution chamber, the plurality of concentrical shafts comprises a central shaft as well an outer hollow shaft surrounding the central shaft, whereby in the central shaft at least one lubricant pipe connected with a lubricant supply is arranged, the lubricant pipe is connected with a plurality of bearings of the plurality of rotors via a radial lubricant duct, wherein the plurality of concentrical shafts comprises in the area of the plurality of concentrical shafts' lubricant ducts, one radial extending lubricant channel which abuts to a wall of the plurality of concentrical shafts in an area of the the plurality of concentrical shafts lubricant ducts located therein.

2. The comminution device according to claim 1, wherein the plurality of concentrical shafts' lubricant duct leads to an annular section in which a shaft bearing is located.

3. The comminution device according to claim 2, wherein the annular section is defined in a first axial direction by a bearing and in an opposite second axial direction by a lubricant seal.

4. The comminution device according to claim 3, wherein the lubricant seal is permeable to gas.

5. The comminution device according to claim 1, in which the radial extending lubricant channel comprises at least in an area abutting to the wall a contact material which has a low friction with respect to a material of the shaft.

6. The comminution device according to claim 1, wherein at an end face of the plurality of rotors the lubricant pipe is connected with an annular feed chamber.

7. The comminution device according to claim 1, wherein in the central shaft there is an inner space and/or between the plurality of concentrical shafts there is a plurality of intermediate spaces, the plurality of intermediate spaces are provided as at least partially gas feed spaces in connection with a gas supply, the gas feed spaces are connected with at least one shaft bearing arranged between the plurality of concentrical shafts.

8. The comminution device according to claim 7, wherein the gas feed space is connected to a rotary mounted end piece comprising a gas feed opening to be connected with the gas supply.

9. The comminution device according to claim 7, wherein at least one of the plurality of concentrical shafts comprise a radially extending gas duct being connected to a shaft bearing.

10. The comminution device according to claim 9, wherein the gas leads to a first annular gas section which is defined in a first axial direction by a bearing and in an opposite second axial direction by an annular gas seal.

11. The comminution device according to claim 7, wherein all of the plurality of intermediate spaces between the plurality of concentrical shafts are connected to a gas supply.

12. The comminution device according to claim 1, wherein the central shaft comprises an axial hollow space which is on one hand connected with an intermediate space via a gas duct extending radially in the central shaft and is connected with a gas supply.

13. The comminution device according to claim 12, wherein the gas supply is realized by a fan.

* * * * *